United States Patent [19]

Brun

[11] 4,358,267

[45] Nov. 9, 1982

[54] DEVICE FOR GUIDING BAND MATERIAL AND APPLICATIONS THEREOF

[75] Inventor: Charles Brun, Montataire, France

[73] Assignee: Union Siderurgique du Nord et de l'Est de la France, Paris, France

[21] Appl. No.: 247,551

[22] Filed: Mar. 25, 1981

[30] Foreign Application Priority Data

Mar. 26, 1980 [FR] France ..... 80 06670

[51] Int. Cl.[3] ..... F27B 9/28; B65H 17/22; B65H 75/02; C21D 9/52

[52] U.S. Cl. ..... 432/59; 198/840; 226/189; 242/55.01; 266/102

[58] Field of Search ..... 432/8, 59; 266/102, 266/103; 198/840, 842; 226/189; 242/55.01

[56] References Cited

U.S. PATENT DOCUMENTS 2,232,391 2/1941 Keller ..... 432/8
3,188,063 6/1965 Costakis ..... 432/8
3,306,594 2/1967 Bauer ..... 432/8
3,401,860 9/1968 Frantzen ..... 266/199
3,871,816 3/1975 Strong ..... 432/8

FOREIGN PATENT DOCUMENTS 1101433 10/1955 France .
1248731 11/1960 France .

*Primary Examiner*—John J. Camby
*Attorney, Agent, or Firm*—Cushman, Darby & Cushman

[57] ABSTRACT

The device is so improved as to decrease the tensile forces to be exerted on the band. For this purpose, the axes of the lower rollers and upper rollers, when viewed in projection on a horizontal plane, make with the perpendicular to the line of travel of the band equal and opposite angles.

Application in particular in vertical band accumulating means in continuous heat treatment furnaces.

9 Claims, 4 Drawing Figures

DEVICE FOR GUIDING BAND MATERIAL AND APPLICATIONS THEREOF

DESCRIPTION

The present invention relates to devices for guiding a material in the form of a band, of the type comprising at least two series of rollers contained in different horizontal planes, in which planes the band passes alternately from a roller of one series to a roller of the other series.

Such devices are in particular employed in vertical accumulating means inserted in continuous band treating lines so as to form a reserve of band allowing the slowing down or stoppage of the line upstream of the accumulating means while maintaining the operating speed on the downstream side, or inversely, the slowing down or stoppage of the line doenstream of the accumulating means while maintaining the normal operating speed upstream of the accumulating means. In such accumulating means there are provided a series of lower (or upper) fixed rollers and a series of upper (or lower) rollers carried by a frame which is vertically movable as a function of the length of material present at a given instant in the accumulating means.

A similar arrangement is also employed in continuous treating furnaces, and in particular in annealing furnaces, in which, for the purpose of achieving a sufficient treating time, the band travels through a sinous path by alternately passing from one roller of a series to a roller of another series of rollers. However, in this application, the distance between the lower and upper rollers is constant.

In order to achieve a self-centering of the band on each of the rollers, there is chosen for the latter a biconical or crowned shape having a generally parabolic section, whose maximum diameter is located in the median plane of the roller. With such an arrangement, any accidental offset of the band destroys the equilibrium of the reactions upon contact between the band and the roller and favours the offset side which owing to the offset has a larger area of contact than the other side so that there is achieved a practically automatic recentering of the band relative to the roller. However, owing to this crowned shape, the length of the generatrices of the band varies depending on whether the band is in a median section of the rollers or in an edge or end section thereof, so that if a satisfactory contact is to be obtained between the rollers and the band and consequently a correct guiding of the latter, high tensile forces must be exerted on the band in particular in respect of sheets whose thickness exceeds 2 mm. This is a serious drawback.

Indeed, in the application to vertical band accumulating means, the total force which is exerted on the structure of the tower supporting the series of rollers and which comprises the sum of the tensile forces exerted on each reach or portion of the band, becomes very considerable so that the tower construction must be heavy and expensive.

Further, in the second application contemplated hereinbefore, in the hot chambers of continuous annealing furnaces (chambers for heating and maintaining the temperature) the band brought to relatively elevated temperatures can only support very small tensile forces. In the heating zone, the rollers are brought to an elevated temperature and the band is substantially cooler than the roller. Consequently, the expansion of the roller, which is greater outside the band than in the zone cooled by the contact with the band, results in a thermal profile which is disadvantageous in respect of the behaviour of the band. Having regard to the temperature of the band and to the crowned shape of the rollers and to the tensile force required for applying the band against the rollers, a permanent deformation may be produced in the band especially is very thin and wide bands.

The problem to solve consequently resides in improving a guiding device of the type defined hereinbefore so as to achieve satisfactory guiding and self-centering of the band for tensile forces less than those required in the known devices.

Consequently, the invention provides a device for guiding a band material, comprising at least two series of rollers contained in different horizontal planes, in which the band passes alternately from a roller of one series to a roller of another series, wherein, when viewed in projection on a horizontal plane, the axes of the rollers of one series, which are parallel to one another, make with the axes of the rollers of the other series, which are also parallel to one another, an acute angle whose bisector is perpendicular to the mean direction of travel of the band.

The invention will be described in more detail hereinafter with reference to the accompanying drawing which is given merely by way of example and in which.

Figure 1:
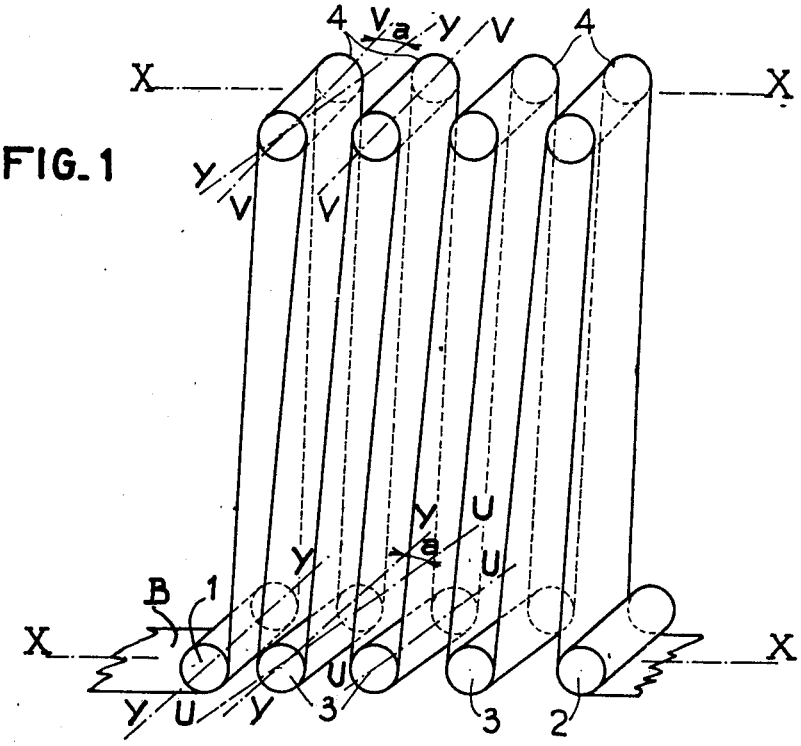
FIG. 1 is a diagrammatic perspective view showing the position of the guide rollers in a vertical band accumulating means according to the invention.

FIG. 1 shows a device for guiding a material in the form of a band B which may, for example, be employed in a vertical band accumulating means inserted in a continuous treating line. Such an accumulating means comprises a tower, a fixed lower frame in which are journalled the rollers of a first series fof rollers, and a vertically movable upper frame in which are journalled the rollers of a second series of rollers. However, these various components and devices are perfectly well known and conventional and have not been shown in the drawing, a simple diagram being sufficient to reveal the features of the invention.

Figure 2:
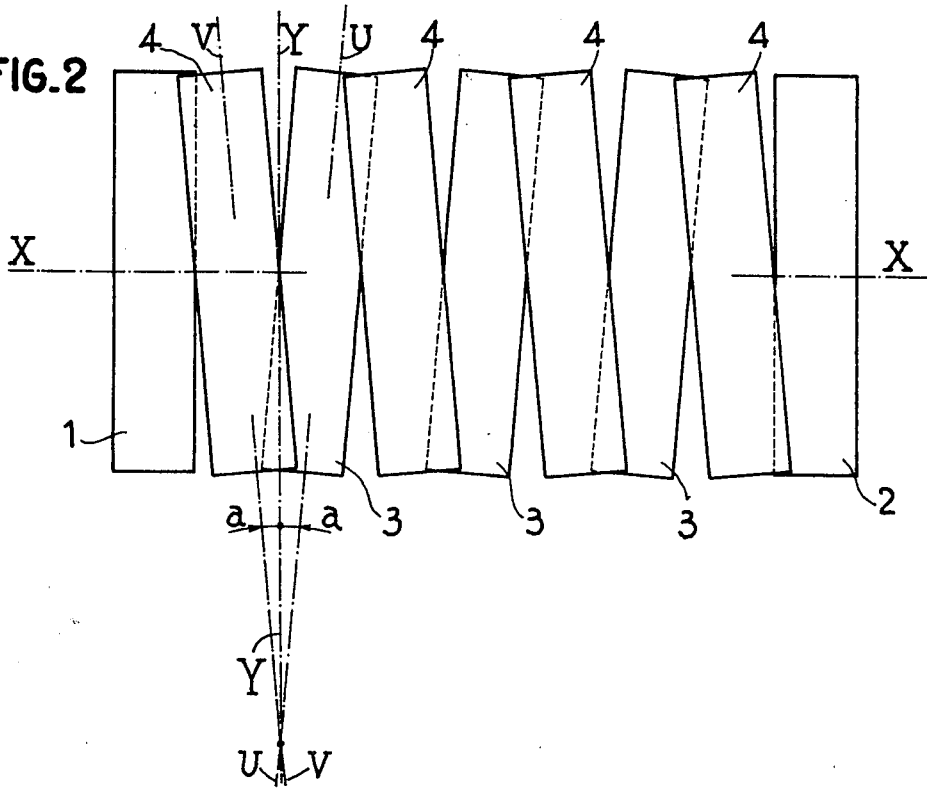
FIG. 2 is a plan view of the device of FIG. 1.

The device comprises an input roller 1 and an output roller 2 of the accumulating means, these two rollers, whose axes are perpendicular to the direction X—X of travel of the band, being located at the same level as a series of lower rollers 3. The guide device is completed by a series of upper rollers 4. As can be seen more particularly in FIG. 2, when viewed in projection on a horizontal plane, the axes U—U and V—V of the lower and upper rollers make with each other acute angles whose bisector Y—Y is perpendicular to the direction X—X of travel of the band. In other words, the axes of the lower rollers and the axes of the upper rollers make with respect to the perpendicular to this direction of travel acute angles a which are equal and opposite and preferably less than 45°.

While this is not clear in the drawing, owing to its small scale, the rollers have a crowned shape and, according to the invention, a relationship is established between the angle a and the value of this crowning which may be characterized by the difference between the maximum diameter and minimum diameter of the roller. Preferably, the roller has a profile of parabolic shape. The relation between the angle a and the value of the crowning is adapted to achieve a compensation for the variation in length of the generatrices of the band, between two consecutive rollers, which results from the crowned shape of the rollers. If b represents the difference between the maximum and minimum values of the diameter of the roller, 1 the length of this roller and d the distance between the horizontal planes containing the axes of the upper and lower rollers, the angle a is preferably chosen in such manner that:

$$\sin^2 a = \pi bd/l^2$$

which corresponds to a perfect compensation.

Figure 3:
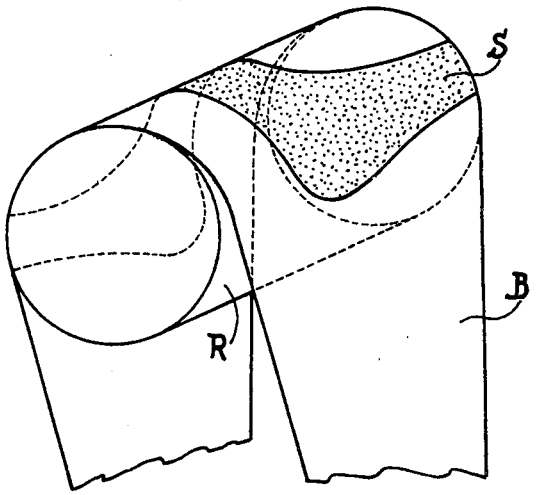
FIG. 3 is a detail view showing the zones of contact between the band and the rollers in a particular condition of operation, and, FIG. 4 is a diagrammatic view of a device according to the invention employed in a continuous heat treating furnace.

However, in the considered application, bearing in mind that the distance d varies in the course of operation of the accumulating means, it is in practice impossible to compensate for the differences of lengths in the path of the band. If the angle a is larger than the value calculated by means of the aforementioned formula, the tension is higher on the edges and the edges of the band are strongly applied against the roller while the contact may be less good in the centre of the roller. Under these conditions, the guiding remains satisfactory since, as the variation of section of the roller becomes greater as one becomes more remote from its axis, it is the edge contact which is essential for the guiding. If, inversely, the angle a is less than the calculated value, the tension becomes higher in the centre part of the band, and the latter is applied less closely against the edges of the rollers. However, it may be seen, as shown in FIG. 3, that the surface of contact S between the band B and the roller R in such a situation is such that this contact is maintained on the side where the torsion of the band tends to move it toward the roller so that the guiding remains satisfactory Therefore, a is chosen so that the aforementioned relation is satisfied for a mean distance between the two series of rollers.

According to a feature of the invention, the upper rollers and the lower rollers may not have the same crowned characteristics, the upper rollers having a more marked profile than their corresponding lower rollers. Indeed, under the the effect of its weight, the band is applied more effectively on the upper rollers which may consequently have a variation in section which is greater than the lower rollers. There results a good contact of the band with the rollers and perfect guiding for the entire effective travel through the accumulating means.

By way of example, a band accumulating means is constructed with the series of lower and upper rollers inclined respectively at more or less 20° relative to the perpendicular to the line of travel of the band. The input and output rollers, located as shown in the drawing roughly in the region of the fixed rollers, are perpendicular to this line of travel. As the angle of torsion of the input and output portions of the band are less than in the normal major part of the accumulating means, there is adopted for these input and output rollers a crowned value which is substantially less. But, for an angle a of 20° and a maximum distance d of 80 m between the lower and upper rollers, the crown of the input and output rolles is b=1 mm in respect of l=2 m while the crown shape of the rollers of the accumulating means proper is between 2 and 10 mm and may be preferably of the order of 6 mm in respect of the same length of 2 m.

As mentioned above, there may be advantageously provided a higher crown value for the upper rollers in respect of which the tension of the band is greater. Thus, for a band having a thickness of 3 mm and a width of 1,500 mm, and a roller diameter of 1,000 mm, the minimum input tension is 3,000 Newtons and for an accumulating means of a height of 80 m, providing an effective band travel of 60 m, the maximum tension in the region of the upper rollers is about 32,000 Newtons. A crown of 9 mm may then be chosen for the upper rollers and a crown of 3 mm for the lower rollers. The minmum tension at the output of the band accumulating means having eight band reaches or portions is about 15,000 Newtons.

With the arrangement according to the invention and the orientation of the axes of the upper and lower rollers, the length of all the generatrices of the band between two consecutive rollers are roughly equal so that a satisfactory contact of the band with the roller may be achieved with a lower tensile force which is just sufficient to bend the band in contact with the roller. The different characteristics chosen for the input, lower and upper rollers still further improves this result.

It will be understood that the invention may be carried out under similar conditions in the case of an accumulating means in a pit whose upper rollers are fixed and lower rollers are carried by a vertically movable frame. In this case, the input and output rollers are located in the vicinity of the fixed upper rollers.

Figure 4:
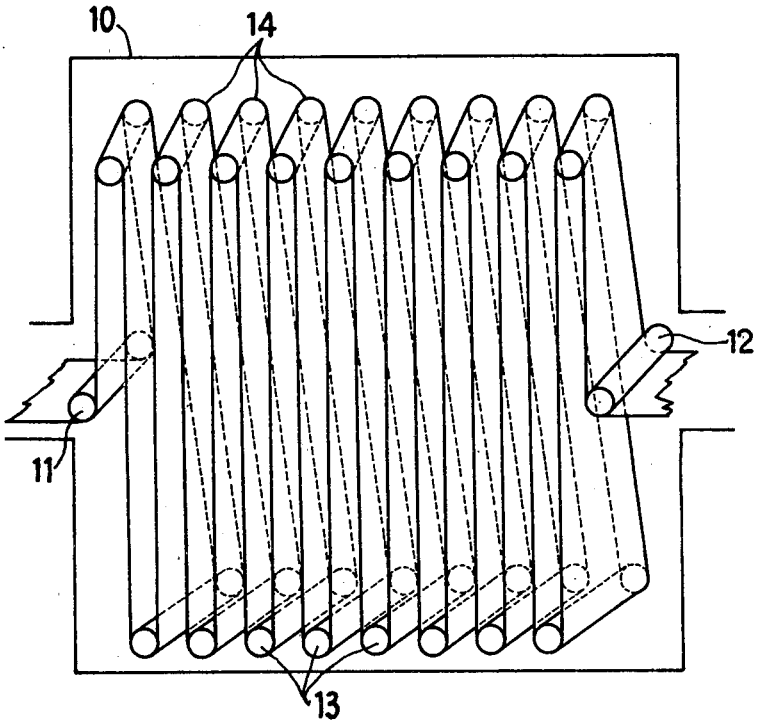

In another application (FIG. 4), a device according to the invention is employed in a heat treating furnace 10 and in particular in a continuous annealing furnace for a band material. In this application, the input roller 11 and the output roller 12, whose axes are perpendicular to the line of travel of the sheet of band, are located roughly midway up the height of the furnace and of the guide device.

As in the foregoing embodiment, the rollers 13 of the lower series are inclined at an angle of +a relative to the perpendicular to the line of travel, and the rollers 14 of the upper series are inclined at an angle of −a relative to this perpendicular. This arrangement is particularly well adapted to this application, since the distance between the upper and lower rollers is invariable so that the relation between the angle a and the value of the crown of the lower and upper rollers may be so chosen as to obtain a length of generatrix which is roughly constant throughout the width of the band in its travel in the guide device.

Further, in this case, no attempt is made to compensate for the whole of the crown given to the rollers but only the crown resulting from thermal deformation. By way of example, the following values may be given: with rollers having a diameter of 700 mm and a length of 1,600 mm and spaced apart 18 m, the angles a are 15° so that it is possible to compensate for a crown having a diameter differential of 3 mm. Bearing in mind the heat thermal deformation of the rollers, the crown machined at ambient temperature is between 4 and 8 mm for the rollers of the heating zone of the furnace and may be 2 to 4 mm for the rollers in the temperature maintaining and cooling zones. The input and output rollers of each chamber are, as in the illustrated embodiment, disposed half way up the height of the furnace and are perpendicular to the line of travel of the band. The value of the crowns of the input and output rollers is between 1 and 2 mm.

It must be understood that the heating devices which are incorporated in the furnace and which generally extend from the lateral walls of the latter, must be arranged bearing in mind the helical path of the bands inside the furnace. The position and orientation of these heating means are determined by the form of the gaps defined between two adjacent portions or reaches of the band.

It will be clear from the foregoing description that the arrangement according to the invention provides a particularly effective and elegant solution to an important problem. The decrease in the tensile forces required for achieving correct driving and guiding of the band in the device constitutes a substantial progress in the various considered applications, in particular when the band is brought to a relatively elevated temperature and is consequently liable to undergo permanent deformations.

Having now described my invention what I claim as new and desire to secure by Letters Patent is:

1. A device for guiding a band of material, comprising at least two series of rollers having axes of rotation contained in different horizontal planes and means supporting said series of rollers, the band passing alternately from a roller of one series to a roller of the other series, wherein, when viewed in projection on a horizontal plane, the axes of the rollers of one of said series are parallel to each other and make with the axes of the rollers of the other of said series an acute angle a whose bisector is perpendicular to the mean direction of travel of the band through the device, the axes of the rollers of said other series being parallel to each other.

2. A device according to claim 1, wherein the axes of a series of rollers make with the perpendicular to said mean direction of travel of the band an angle a which is less than 45°.

3. A device according to claim 1 or 2, comprising an input roller and an output roller which have axes of rotation which are perpendicular to said mean direction of travel of the band.

4. A device according to claim 1 or 2, wherein said rollers are crowned and values of said angle a and of the crown of the rollers are so chosen that the following relation is at least substantially satisfied:

$$\sin^2 a = \pi bd/l^2$$

ps in which b is the difference between the maximum and minimum diameter of the roller, l is the length of a roller, d is the distance between the horizontal planes containing the axes of the upper and lower series of rollers.

5. A device according to claim 4, wherein the distance between the two series of rollers is variable and the values of said angle a and of the crown of the rollers are so chosen that said relation is substantially satisfied for a mean distance between the two series of rollers.

6. A device according to claim 1 or 2, wherein the rollers are crowned and the rollers of the higher series of rollers are more crowned than the rollers of the lower series of rollers.

7. A device according to claim 6, comprising an input roller and an output roller which are less crowned than the rollers of the upper and lower series of rollers.

8. A device according to claim 4, wherein the device operates at a given temperature and said angle a is so chosen as to compensate for differences in length of generatrices of the band corresponding to the crown resulting from thermal deformation of the roller.

9. An installation for treating a band comprising heating chamber and a device for guiding the band, said device comprising at least two series of rollers having axes of rotation contained in different horizontal planes and means supporting said series of rollers, the band passing alternately from a roller of one series to a roller of the other series, wherein, when viewed in projection on a horizontal plane, the axes of the rollers of one of said series are parallel to each other and make with the axes of the rollers of the other of said series an acute angle a whose bisector is perpendicular to the means direction of travel of the band through the device, the axes of the rollers of said other series being parallel to each other, said heating means being disposed and oriented in such manner as to extend in gaps between adjacent portions of the band.

* * * * *